US012390683B2

(12) United States Patent
Hu et al.

(10) Patent No.: US 12,390,683 B2
(45) Date of Patent: Aug. 19, 2025

(54) KIND OF TREADMILL FOLDING MECHANISM AND TREADMILL

(71) Applicant: Yongkang Tiantian Aipao Intelligent Technology Co., Ltd., Zhejiang (CN)

(72) Inventors: Jiachen Hu, Zhejiang (CN); Zhiping Zhou, Zhejiang (CN)

(73) Assignee: Yongkang Tiantian Aipao Intelligent Technology Co., Ltd., Jinhua (CN)

( * ) Notice: Subject to any disclaimer, the term of this patent is extended or adjusted under 35 U.S.C. 154(b) by 203 days.

(21) Appl. No.: 18/338,321

(22) Filed: Jun. 20, 2023

(65) Prior Publication Data

US 2023/0405396 A1 Dec. 21, 2023

(30) Foreign Application Priority Data

Jun. 21, 2022 (CN) ..... 202221553434.0

(51) Int. Cl.
*A63B 22/02* (2006.01)
*A63B 21/00* (2006.01)

(52) U.S. Cl.
CPC ..... *A63B 22/02* (2013.01); *A63B 21/4035* (2015.10); *A63B 2210/50* (2013.01)

(58) Field of Classification Search
CPC ..... A63B 21/008; A63B 21/0083; A63B 21/0085; A63B 21/0087; A63B 21/158; A63B 21/159; A63B 21/4035; A63B 21/4047; A63B 21/4049; A63B 22/0046; A63B 22/02; A63B 71/0036; A63B 2210/00; A63B 2210/50; A63B 2210/58; A63B 2225/09; A63B 2225/093
See application file for complete search history.

(56) References Cited

U.S. PATENT DOCUMENTS 6,890,287 B2 * 5/2005 Chen ..... A63B 22/02 482/54
7,727,122 B2 * 6/2010 Kuo ..... A63B 22/0235 482/54
2004/0023758 A1 * 2/2004 Chang ..... A63B 22/02 482/54
2004/0087417 A1 * 5/2004 Lo ..... A63B 22/02 482/54
2004/0132585 A1 * 7/2004 Chen ..... A63B 22/02 482/54

(Continued)

FOREIGN PATENT DOCUMENTS

CN 109481900 A * 3/2019 ..... A63B 22/02
CN 110860063 A * 3/2020 ..... A63B 22/02

*Primary Examiner* — Gary D Urbiel Goldner

(57) ABSTRACT

Disclosed are a treadmill folding mechanism and a treadmill. This folding mechanism includes: a mounting seat, mounted on a body of a treadmill; a positioning rod, having one end hinged on a column of the treadmill, and another end connected to the mounting seat, and including movable space compatible with at least part of the mounting seat; and a handle, connected to one end of the mounting seat through the positioning rod. The present disclosure can limit the positioning rod and the column of the treadmill by turning the handle, which is convenient to operate, simple in structure, long in service life, and has high stability of the column of the treadmill after locking, and at the same time, can lock the column when unfolded and folded.

18 Claims, 5 Drawing Sheets

(56) References Cited

U.S. PATENT DOCUMENTS

| | | | | |
|---|---|---|---|---|
| 2004/0266589 | A1* | 12/2004 | Tsou | A63B 22/0023<br>482/54 |
| 2009/0057505 | A1* | 3/2009 | Chen | B62K 21/24<br>248/185.1 |
| 2019/0290956 | A1* | 9/2019 | Ren | A63B 22/02 |

* cited by examiner

KIND OF TREADMILL FOLDING MECHANISM AND TREADMILL

CROSS-REFERENCE TO RELATED APPLICATIONS

This application claims priority of Chinese Patent Application No. 202221553434.0, filed on Jun. 21, 2022, the entire contents of which are incorporated herein by reference.

TECHNICAL FIELD

The invention relates to the field of treadmill technology, in particular a treadmill folding mechanism and treadmill.

BACKGROUND TECHNOLOGY

With the improvement of people's living standards and the promotion of national fitness sports, the user's demand for treadmills is increasing, there are many types of treadmills, among which, foldable treadmills are more suitable for indoor use, which occupies less space and are deeply loved by the majority of users.

The foldable treadmill usually has a foldable treadmill column, and the existing treadmill column folding mechanism has a complex structure, or is not stable enough, or easy to damage, so the applicant improves it.

INVENTION CONTENT

The invention for the shortcomings of the current technology, the invention provides a treadmill folding mechanism and treadmill.

For the shortcomings of the prior art, the invention provides a folding mechanism for a treadmill and a treadmill.

The invention solves the above technical problems by the following technical solutions:

a treadmill folding mechanism comprising:

mounting seat, which is mounted on the body of the treadmill;

positioning rod, one end hinged on the treadmill column, the other end connected to the said mounting seat, and comprising an activity space compatible with at least part of the said mounting seat; and handle, the said handle is connected to one end of the mounting seat through the positioning rod, and the said positioning rod is limited when the said handle is folded; when the said handle is unfolded, the said positioning rod releases the limit.

In the above scheme, preferably, the said mount comprises connecting base and active unit, the said connecting base is provided with a movable hole, the active unit is assembled at the movable hole, the outer end of the active unit is pierced at the said movable space and connected to the said handle;

The said mounting seat further comprises a fixing member fixed on the treadmill body, and the said connecting seat is fixed to the said fixing member;

The said connecting seat includes a positioning notch with a diameter larger than the said movable hole.

In the above scheme, preferably, the end of the said active unit close to the treadmill body comprises a limit head that matches the said positioning notch, and when the said handle is folded, the wall top of the said limit head is against the wall of the said positioning notch.

In the above scheme, preferably, the said positioning rod comprises a plurality of limit notches matching with the said handle, and when the said handle is folded, the eccentric part on the said handle is stuck into the said limit notch to limit the said positioning rod; when the said handle is unfolded, the eccentric part on the said handle releases the limit on the said positioning rod.

In the above scheme, preferably, the said limit notch comprises at least two ends, respectively located at both ends of the said activity space, to limit the treadmill column when unfolding and storage;

The said handle is an eccentric handle.

In the above scheme, preferably, the said positioning rod includes a telescopic mechanism, one end of the said telescopic mechanism is positioned on the said positioning rod, and the other end is installed on the said active unit.

In the above scheme, preferably, the said positioning rod is provided with a mounting groove connected to the said activity space, and the said telescopic mechanism is installed in the said mounting groove.

In the above scheme, preferably, the said positioning rod is equipped with a first pin shaft, one end of the said telescopic mechanism is fixed on the said first pin shaft, and the other end is threaded on the said active unit;

the other end of the said telescopic mechanism comprises a threaded end, and the said active unit is provided with a threaded hole matched with the thread end of the said telescopic mechanism;

The said telescopic mechanism is a gas spring.

In the above scheme, preferably, the said positioning rod is provided with an active groove connected to the said activity space, and the active unit is provided with a second pin shaft that can be assembled on the said active groove.

The treadmill, including treadmill body and treadmill column symmetrically disposed on both sides of the treadmill body, characterized in that: further comprises the folding mechanism as in any of claim 1-9, wherein, the mounting seat of the folding mechanism is mounted on the treadmill body, the positioning rod is hinged on the treadmill column, when the said handle is folded to limit the positioning rod, the said treadmill column is limited by rotation relative to the treadmill body.

The beneficial effects of the invention are:

The invention can limit the positioning rod and treadmill column by turning the handle, which is convenient to operate, simple in structure, long in service life, and has high stability of the treadmill column after locking, and can be locked when the treadmill column is unfolded and folded.

MODE OF CARRYING OUT THE INVENTION

The invention is further described in detail in conjunction with the drawings and specific mode of carrying out the invention:

See FIGS. 1-7, a treadmill folding mechanism comprising: mounting seat 1, positioning rod 3, and handle 4.

Figure 6:
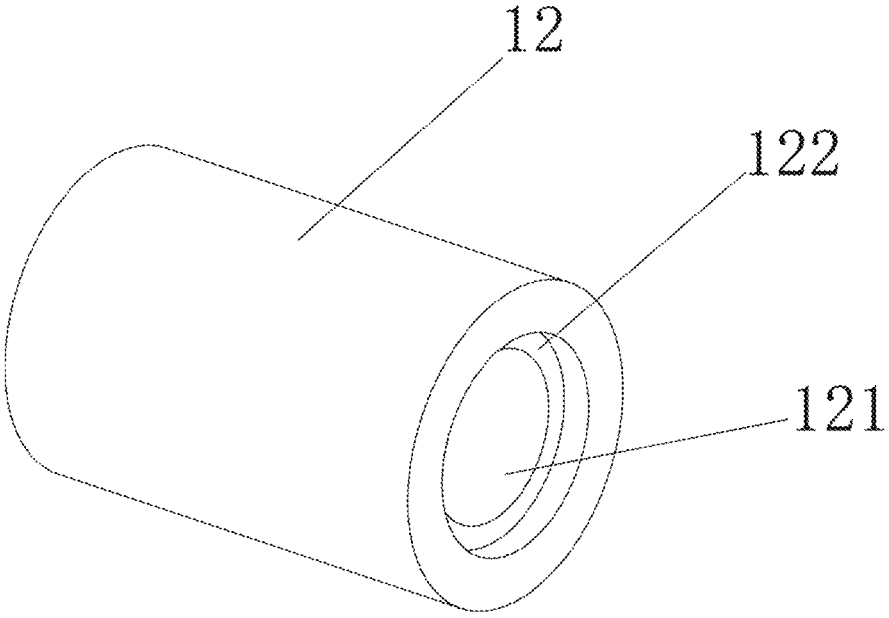
FIG. 6 is a schematic diagram of the connecting seat of the invention.
Figure 7:
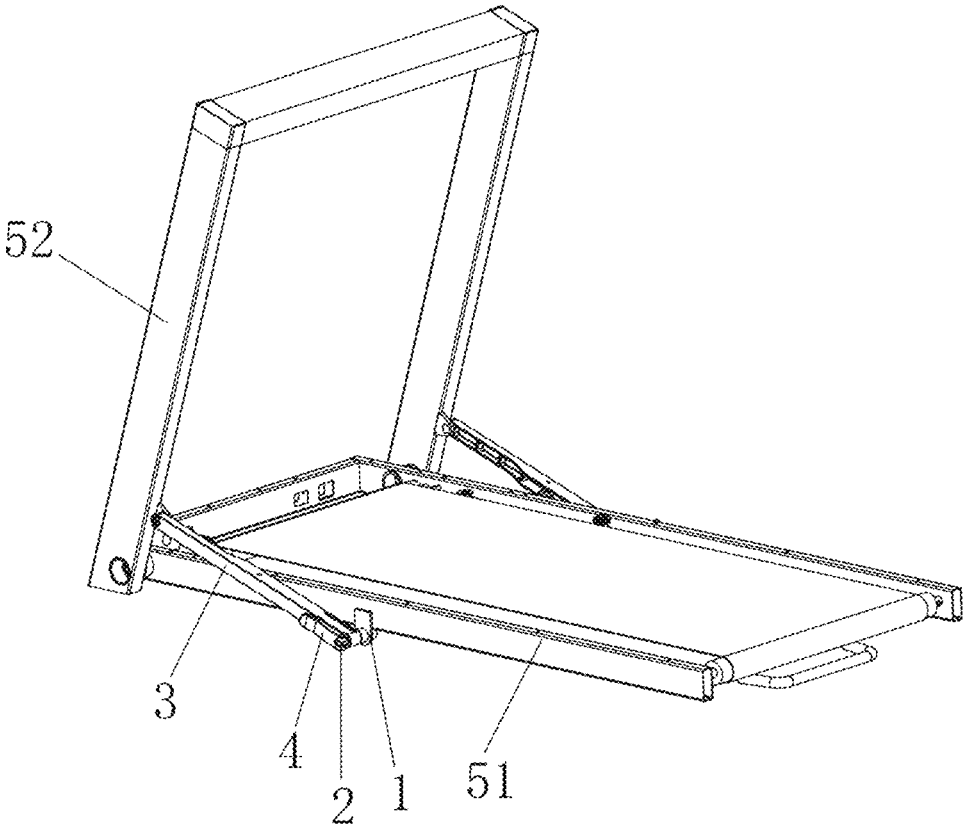
FIG. 7 is a schematic diagram of a treadmill equipped with a folding mechanism of the invention.

Mounting seat 1 can be mounted on the treadmill body 51, which includes fixing member 11, connecting seat 12 and active unit 2, wherein, the fixing member 11 can be fixed and installed on the treadmill body 51, the connecting seat 12 can be fixed on the fixing member 11, the two can be welded or integrated molding, the connecting seat 12 is provided with a movable hole 121, the movable hole 121 can be a penetration hole, or a penetrating round hole, in the meanwhile, the connecting seat 12 further comprises positioning notch 122 with a diameter greater than the movable hole 121, the positioning notch 122 can be formed by an inward depression at one end of the connector, as shown in FIG. 6.

Figure 4:
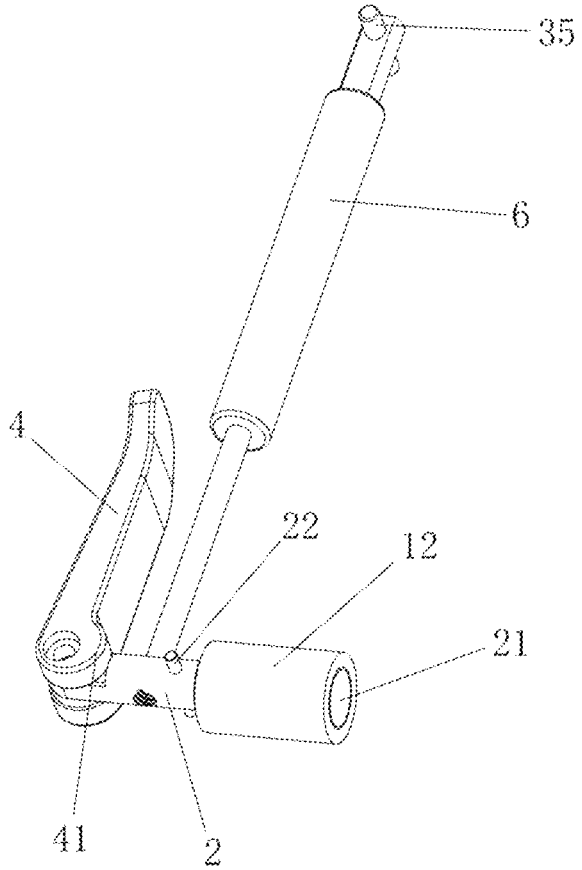
FIG. 4 is a fit diagram of the handle, active unit, mounting seat and telescopic mechanism of the invention.

The active unit 2 is assembled at the movable hole 121, the shape and size of which can be consistent with the movable hole 121, the end near the treadmill body 51 includes a limit head 21 matched with the positioning notch 122, the shape and size of the limit head 21 can be consistent with the shape and size of the positioning notch 122, the matching form of the two can be shown in FIG. 4, when the handle 4 is folded, the wall of the limit head 21 can be against the wall of the positioning notch 122, the active unit 2 is designed to be removable for subsequent maintenance, easy to disassemble and assemble.

One end of the positioning rod 3 is hinged on the treadmill column 52, and the other end is connected to the active unit 2, and includes activity space 31 in conjunction with the active unit 2, the activity space 31 can be in the form of a long groove hole, the active unit 2 is assembled in the activity space 31, one end of the active unit 2 away from the treadmill body 51 passes through the activity space 31 and is connected to the handle 4, and the handle 4 is rotated and disposed on the active unit 2.

Activity space 31 provides the space required to drive the positioning rod 3 when the treadmill column 52 is folded, that is, when the treadmill column 52 is unfolded, the active unit 2 is close to or against one end of the activity space 31, when the treadmill column 52 is folded, the active unit 2 is close to or against the other end of the activity space 31.

In the embodiment, after the positioning rod 3 is locked, the treadmill column 52 can be limited, specifically, the handle 4 can be an eccentric handle, which includes eccentric part 41, correspondingly, the positioning rod 3 includes a number of limit notches 32 that are matched with the handle 4, as one of the embodiments, the limit notch 32 includes at least two, respectively located at both ends of the activity space 31, to limit the treadmill column 52 when unfolded and stored.

For the treadmill column 52 after unfolding, the eccentric part 41 of the handle 41 is snapped into the corresponding limit notch 32 by folding the handle 4 and locks the positioning rod 3, the folding direction of the treadmill column 52 is limited by the handle 4, when it needs to be folded, expand the handle 4, the eccentric part 41 of the handle 4 can be lifted to release the limit of the positioning rod 3.

After the treadmill column 52 is folded, in the same way, fold the handle 4 until the handle eccentric 41 part is snapped into the corresponding limit notch 32.

Figure 1:
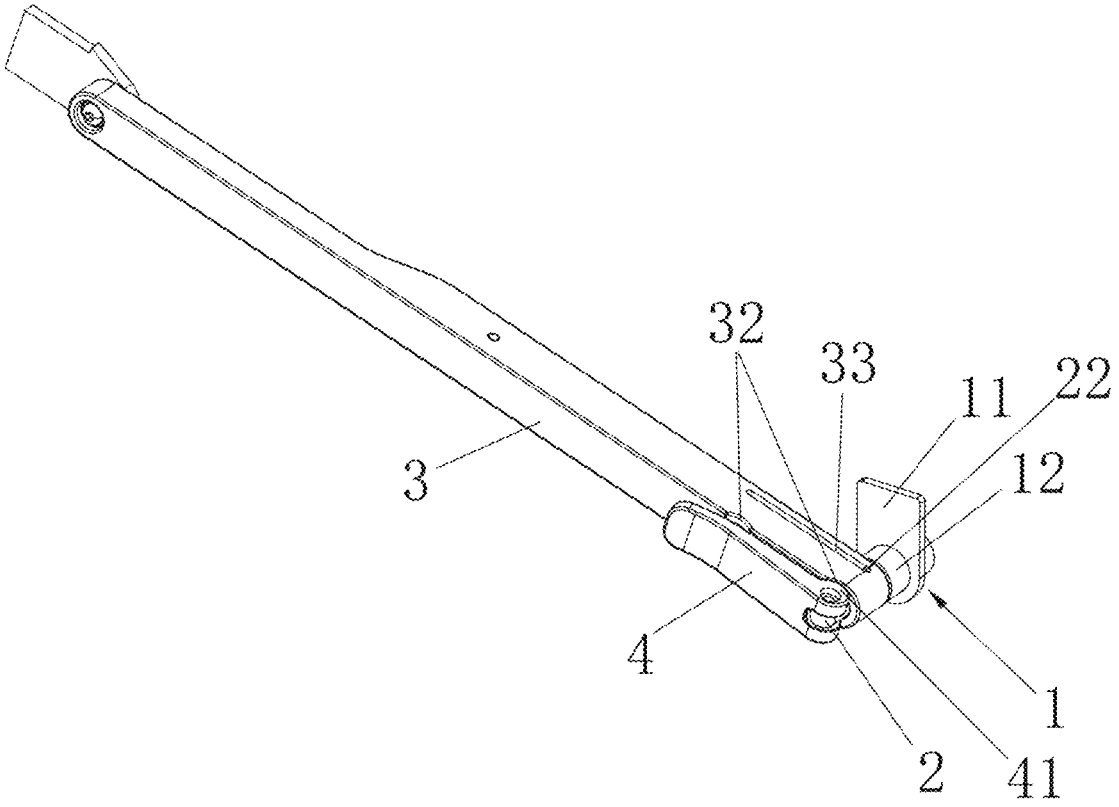
FIG. 1 is a schematic diagram of the folding mechanism of the invention.
Figure 2:
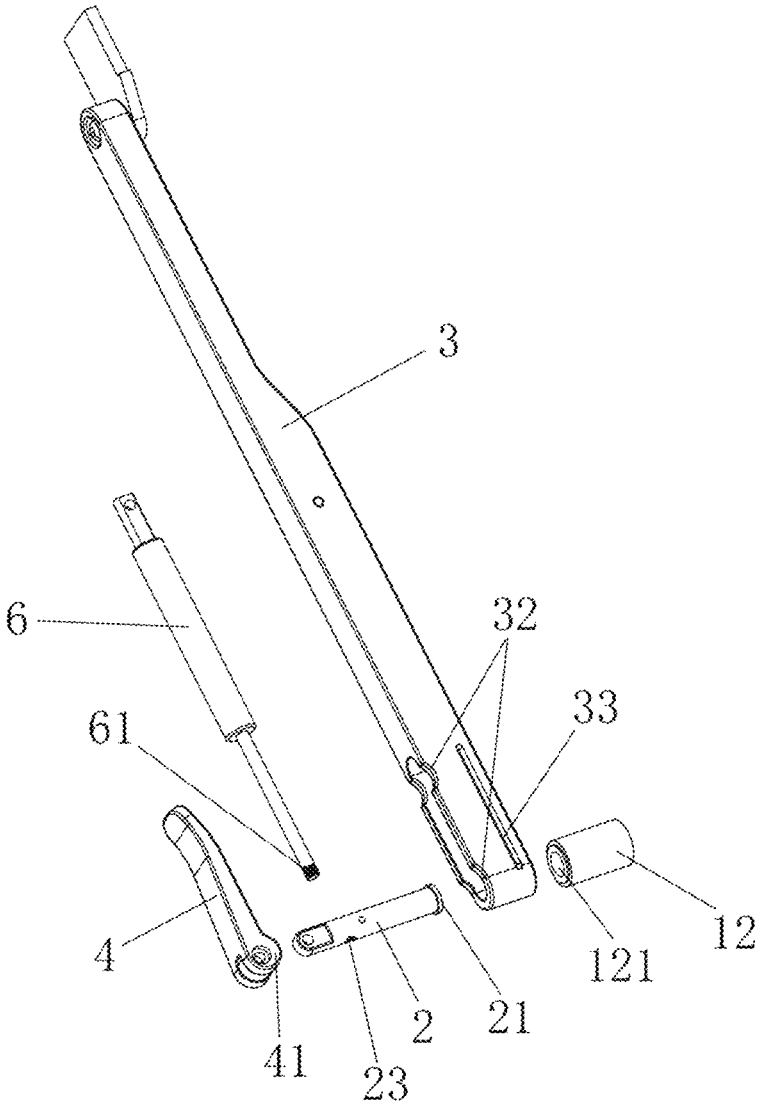
FIG. 2 is a decomposition diagram of the folding mechanism of the invention.
Figure 3:
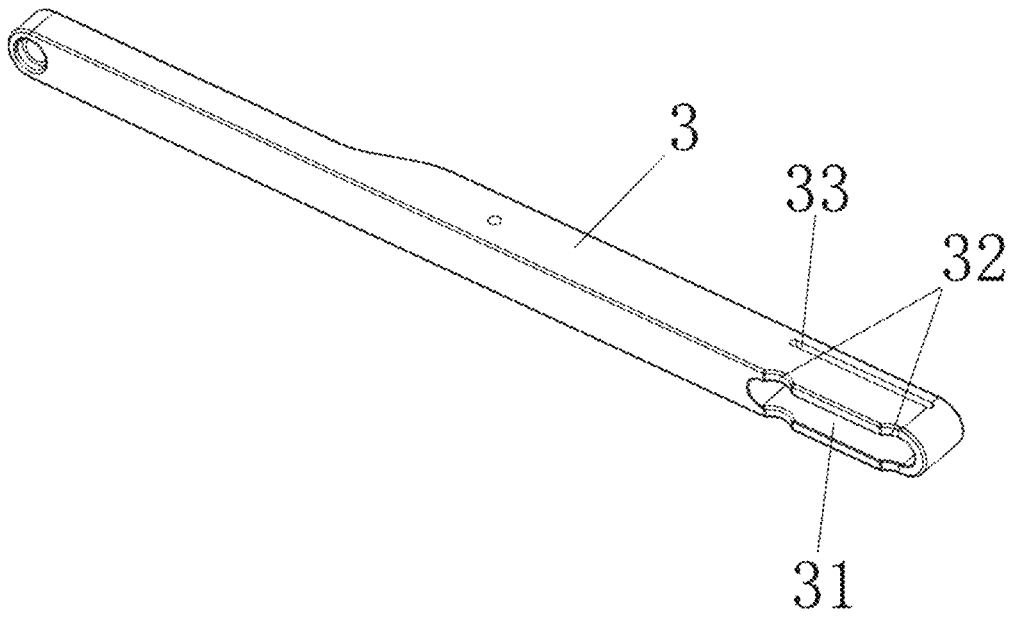
FIG. 3 is a schematic diagram of the positioning rod of the invention.

In order to make the active unit 2 more stable on the positioning rod 3, the active groove 33 connected to the movable space 31 can be provided on the positioning rod 3, correspondingly, the active unit 2 can be equipped on the active groove 33 second pin shaft 22, the matching method is shown in FIG. 1, and the second pin shaft 22 can be fixed on the active unit 2.

Figure 5:
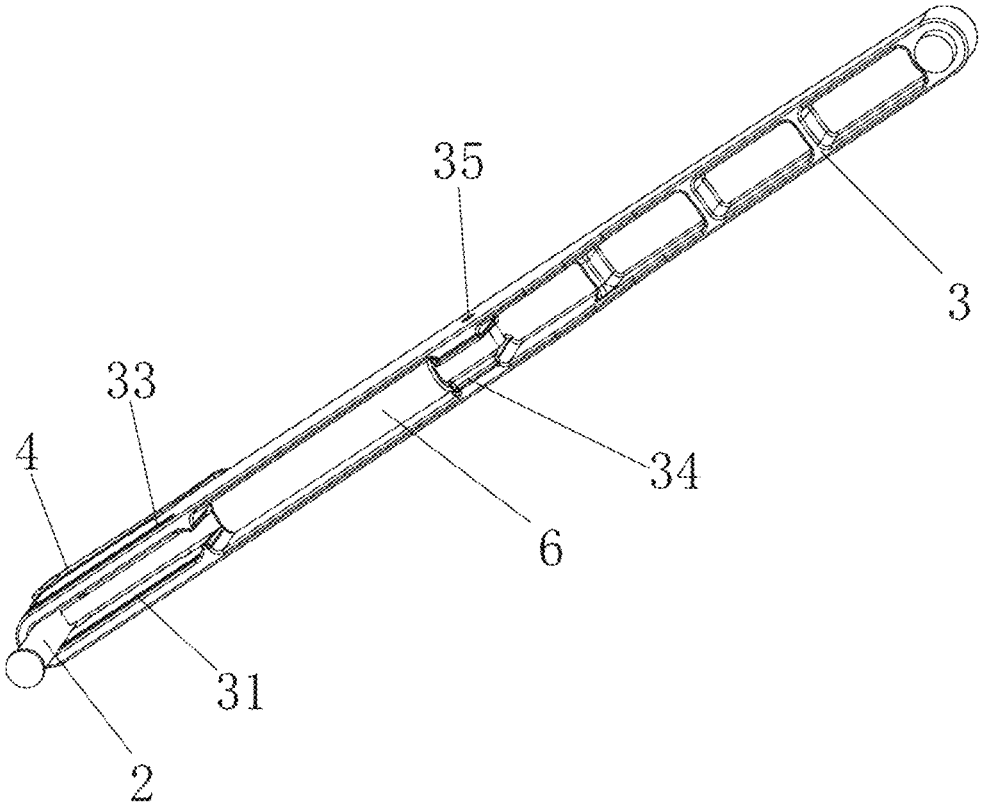
FIG. 5 is a schematic diagram of the telescopic mechanism assembled on a positioning rod of the invention.

Further, in order to make the treadmill column 52 easier when unfolded, to provide a certain damping when folded, the telescopic mechanism 6 can be provided on the positioning rod 3, specifically, the positioning rod 3 can be opened in the mounting groove 34 connected to the activity space 31, the telescopic mechanism 6 is installed in the mounting groove 34, as shown in FIG. 5, further, the positioning rod 3 is equipped with first pin shaft 35, one end of the telescopic mechanism 6 is fixed on the first pin shaft 35, and the other end is mounted on the active unit 2.

For the telescopic mechanism 6 and the active unit 2 matching mode, as one of the embodiments, the threaded hole 23 can be opened on the active unit 2, the corresponding end of the telescopic mechanism 6 is the thread end 61, the thread end 61 is assembled at the threaded hole 23 of the active unit 2, and the telescopic mechanism 6 can be a gas spring.

In the embodiment, when the treadmill column 52 is in the folded and unfolded state, corresponding is the active unit 2 in the activity space 31 activity, therefore, in accordance with the above design of the telescopic mechanism 6, it can provide the corresponding auxiliary force when the treadmill column 52 is unfolded, and provide the corresponding damping when the treadmill column 52 is folded.

Referring to FIG. 1-7, a treadmill, comprising treadmill body 51 and treadmill column 52 symmetrically disposed on both sides of the treadmill body 51, each treadmill column 52 corresponds to the installation of the folding mechanism, wherein, the mounting seat 1 of the folding mechanism is mounted on the treadmill body 51, the positioning rod 3 is hinged on the treadmill column 52, when the handle 4 is folded until the positioning rod 3 is limited, the said treadmill column 52 is limited by rotation relative to the treadmill body 51, the specific matching method of the treadmill column 52 and the folding mechanism can be found in the above description.

The above embodiments are only used to illustrate the technical solution of the invention, not to limit it; although the invention is described in detail with reference to the foregoing embodiments, those of ordinary skill in the field shall understand: it can still modify the technical solutions described in the foregoing embodiments, or replace some of the technical features equivalently; and these modifications or replacements do not make the essence of the corresponding technical solutions depart from the spirit and scope of the technical solutions of each embodiment of the invention.

The invention claimed is:

1. A treadmill folding mechanism, comprising:

a mounting seat, mounted on a body of a treadmill;

a positioning rod, having one end configured to be hinged on a column of the treadmill, and another end connected to the mounting seat, and comprising movable space compatible with at least part of the mounting seat; and a handle, connected to one end of the mounting seat through the positioning rod, wherein when the handle is folded, the positioning rod is limited; and wherein when the handle is unfolded, the limiting of the positioning rod is released.

2. The treadmill folding mechanism in accordance with claim 1, wherein the mounting seat comprises a connecting seat and movable unit, the connecting seat is disposed with a movable hole, the movable unit is assembled at the movable hole, and an outer end of the movable unit is pierced at the said movable space and connected to the handle;

the mounting seat further comprises a fixing member fixedly mounted on the body of the treadmill, and the connecting seat is fixed to the fixing member; and the connecting seat comprises a positioning notch with a diameter larger than the movable hole.

3. The treadmill folding mechanism in accordance with claim 2, wherein an end of the movable unit configured to be close to the body of the treadmill comprises a limit head matched with the positioning notch, and when the handle is folded, a wall of the limit head is abutted against a wall of the positioning notch.

4. A treadmill comprising:

the body of the treadmill in accordance with claim 3;

a pair of columns of the treadmill; and a pair of treadmill folding mechanisms in accordance with claim 3;

wherein the pair of treadmill folding mechanisms are respectively installed on the pair of columns of the treadmill;

wherein the pair of columns of the treadmill are symmetrically arranged on opposing sides of the body of the treadmill; and wherein for each treadmill folding mechanism:

the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

5. A treadmill comprising the body of the treadmill in accordance with claim 2;

a pair of columns of the treadmill; and a pair of treadmill folding mechanisms in accordance with claim 2;

wherein the pair of treadmill folding mechanisms are respectively installed on the pair of columns of the treadmill;

wherein the pair of columns of the treadmill are symmetrically arranged on opposing sides of the body of the treadmill; and wherein for each treadmill folding mechanism:

the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

6. The treadmill folding mechanism in accordance with claim 1, wherein the positioning rod comprises a plurality of limit notches matched with the handle, wherein when the handle is folded an eccentric part on the handle is stuck into a corresponding one of the plurality of limit notches to limit the positioning rod; and wherein when the handle is unfolded, the eccentric part on the said handle releases the limiting of the positioning rod.

7. The treadmill folding mechanism in accordance with claim 6, wherein at least two limit notches are arranged, located at opposing ends of the movable space, to limit the column of the treadmill during unfolding and storage; and the handle is an eccentric handle.

8. A treadmill comprising:

the body of the treadmill in accordance with claim 7;

a pair of columns of the treadmill; and a pair of treadmill folding mechanisms in accordance with claim 7;

wherein the pair of treadmill folding mechanisms are respectively installed on the pair of columns of the treadmill;

wherein the pair of columns of the treadmill are symmetrically arranged on opposing sides of the body of the treadmill; and wherein for each treadmill folding mechanism:

the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

9. A treadmill comprising:

the body of the treadmill in accordance with claim 6;

a pair of columns of the treadmill; and a pair of treadmill folding mechanisms in accordance with claim 6;

wherein the pair of treadmill folding mechanisms are respectively installed on the pair of columns of the treadmill;

wherein the pair of columns of the treadmill are symmetrically arranged on opposing sides of the body of the treadmill; and wherein for each treadmill folding mechanism:

the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

10. The treadmill folding mechanism in accordance with claim 1, wherein the positioning rod comprises a telescopic mechanism, one end of the telescopic mechanism is positioned on the positioning rod, and another end of the telescopic mechanism is mounted on a movable unit of the mounting seat.

11. The treadmill folding mechanism in accordance with claim 10, wherein the positioning rod is disposed with a mounting groove connected to the movable space, and the telescopic mechanism is mounted in the mounting groove.

12. The treadmill folding mechanism in accordance with claim 11, wherein the positioning rod is equipped with a first pin shaft, one end of the telescopic mechanism is fixed on the first pin shaft, and the another end of the telescopic mechanism is threaded on the movable unit;

the another end of the telescopic mechanism comprises a threaded end, and the movable unit is disposed with a threaded hole matched with the threaded end of the said telescopic mechanism; and the telescopic mechanism is a gas spring.

13. The treadmill folding mechanism in accordance with claim 12, wherein the positioning rod is disposed with a movable groove connected to the movable space, and the movable unit is disposed with a second pin shaft assembled on the movable groove.

14. A treadmill comprising:
the body of the treadmill in accordance with claim 13;
a pair of columns of the treadmill; and
a pair of treadmill folding mechanisms in accordance with claim 13;
wherein the pair of treadmill folding mechanisms are respectively installed on the pair of columns of the treadmill;
wherein the pair of columns of the treadmill are symmetrically arranged on opposing sides of the body of the treadmill; and
wherein for each treadmill folding mechanism:
the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

15. A treadmill comprising:
the body of the treadmill in accordance with claim 12;
a pair of columns of the treadmill; and
a pair of treadmill folding mechanisms in accordance with claim 12;
wherein the pair of treadmill folding mechanisms are respectively installed on the pair of columns of the treadmill;
wherein the pair of columns of the treadmill are symmetrically arranged on opposing sides of the body of the treadmill; and
wherein for each treadmill folding mechanism:
the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

16. A treadmill comprising:
the body of the treadmill in accordance with claim 11;
a pair of columns of the treadmill; and
a pair of treadmill folding mechanisms in accordance with claim 11;
wherein the pair of treadmill folding mechanisms are respectively installed on the pair of columns of the treadmill;
wherein the pair of columns of the treadmill are symmetrically arranged on opposing sides of the body of the treadmill; and
wherein for each treadmill folding mechanism:
the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

17. A treadmill comprising:
the body of the treadmill in accordance with claim 10;
a pair of columns of the treadmill; and
a pair of treadmill folding mechanisms in accordance with claim 10;
wherein the pair of treadmill folding mechanisms are respectively installed on the pair of columns of the treadmill;
wherein the pair of columns of the treadmill are symmetrically arranged on opposing sides of the body of the treadmill; and
wherein for each treadmill folding mechanism:
the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

18. A treadmill comprising:
the body of the treadmill in accordance with claim 1;
a pair of columns of the treadmill; and
a pair of treadmill folding mechanisms in accordance with claim 1;
wherein the pair of treadmill folding mechanisms are respectively installed on the pair of columns of the treadmill;
wherein the pair of columns of the treadmill are symmetrically arranged on opposing sides of the body of the treadmill; and
wherein for each treadmill folding mechanism:
the mounting seat of the corresponding treadmill folding mechanism is mounted on the body of the treadmill, the positioning rod is hinged on the corresponding column of the treadmill, and wherein when the handle is folded to limit the positioning rod, the corresponding column of the treadmill is limited by rotation relative to the body of the treadmill.

* * * * *